US005361918A

United States Patent [19]

Mason

[11] Patent Number: 5,361,918

[45] Date of Patent: Nov. 8, 1994

[54] CAP FOR NURSING BOTTLE FOR PROVIDING A COMPARTMENTAL DISPENSING RECEPTACLE

[76] Inventor: Terri L. Mason, 101 Compo Rd. North, Westport, Conn. 06880

[21] Appl. No.: 66,705

[22] Filed: May 24, 1993

[51] Int. Cl.[5] ..... A61J 9/00

[52] U.S. Cl. ..... 215/6; 215/11.1; 215/11.6; 215/227

[58] Field of Search ..... 215/6, 11.1, 11.6, 227, 215/228; 220/4.27, 23.83, 212, 256, 521, 524, 525

[56] References Cited

U.S. PATENT DOCUMENTS

| | | | |
|---|---|---|---|
| 2,488,611 | 11/1949 | Stallings | 220/4.27 X |
| 2,684,167 | 7/1955 | Bruns | 215/6 |
| 2,766,796 | 10/1956 | Tupper . | |
| 2,793,776 | 5/1957 | Lipari . | |
| 2,807,384 | 9/1957 | Lipari | 215/11.1 |
| 2,843,281 | 7/1958 | Gallois . | |
| 3,514,029 | 5/1970 | Powell . | |
| 4,618,444 | 10/1985 | Hudson et al. . | |
| 4,720,351 | 1/1988 | Flynn et al. | 215/6 X |
| 4,823,946 | 4/1989 | Stoeffler et al. | 215/6 X |
| 4,895,264 | 1/1990 | Phlaphongphanich | 215/11.1 |
| 4,971,211 | 11/1990 | Lake . | |
| 5,069,351 | 12/1991 | Gunderson et al. . | |
| 5,085,330 | 2/1992 | Paulin | 215/6 |
| 5,114,011 | 5/1992 | Robbins . | |

*Primary Examiner*—Allan N. Shoap
*Assistant Examiner*—Jes F. Pascua
*Attorney, Agent, or Firm*—Spencer E. Olson

[57] ABSTRACT

An attachment designed to engage the nipple cap of a nursing bottle and serving the function of a nipple shield and also having a compartment for storing a pre-measured amount of powdered baby formula to be mixed, when desired, with water or other diluent stored in the nursing bottle. The bottle with attachment provides a convenient travel container for an infant's meal away from home which can be pre-sterilized and eliminates the need to carry a bulky container of powdered formula and measuring scoop in the usually already overcrowded diaper bag.

10 Claims, 2 Drawing Sheets

12
30
40
16
36
38
10

CAP FOR NURSING BOTTLE FOR PROVIDING A COMPARTMENTAL DISPENSING RECEPTACLE

BACKGROUND OF THE INVENTION

This invention relates to the storage and dispensing of materials and, more particularly, to a cover for a container which together with the container provides a compartmental receptacle in which ingredients of a mixture may be kept separate from each other and thereafter mixed within the container and dispensed as desired.

The container cap of this invention may be utilized with any container having a neck and closure cap of appropriate size and attachment of the container cap of this invention to such container will provide a compartmental dispensing receptacle which is primarily intended to store infant's food in which a pre-measured amount of baby formula or milk in powdered form may be contained in a compartment formed in the container cap, and a pre-measured amount of a suitable diluent, usually water, may be contained in the container, which may be a conventional nursing bottle. Thus, the container cap in combination with a conventional nursing bottle provides a convenient travel container for a baby's meal away from home, eliminating the need to carry a bulky container of baby formula and measuring scoop in the usually already overcrowded diaper bag.

Heretofore, numerous compartmental receptacles have been proposed and utilized, but a majority of these required a special container or receptacle and did not suggest an attachment which might be used with a conventional container, such as a conventional nursing bottle having a nipple sealed to the bottle with a threaded cap. Furthermore, these prior art compartmental receptacles did not include a dispensing means, such as a nipple, and after mixing of the ingredients it was necessary to either transfer the mixture to a special nursing bottle or apply a nipple or other dispensing means to the compartmental receptacle. In the present invention, the cap attachment, in addition to providing a food-storing compartment, includes a protective shield for the nipple, whereby the nipple may be presterilized so as to make the travel container ready for mixing and dispensing upon demand.

It is accordingly an object of the present invention to provide a cap for a container which may be utilized in connection with a conventional container to provide a compartmental dispensing receptacle.

Another object of the invention is to provide an attachment for a container which provides a compartmental dispensing receptacle having two compartments for containing respective ingredients to be mixed and in which the ingredient stored in a compartment formed in such attachment is poured into the container for mixing with the ingredient stored therein.

A more specific object of the invention is to provide a cap for attachment to the nipple cap of a baby's nursing bottle which has a compartment therein for storing a pre-measured amount of powdered baby formula to be mixed when desired with a liquid ingredient stored in the bottle and also shields the nipple secured by the nipple cap.

Another object of the invention is to provide a cap for a baby's nursing bottle which may be economically and conveniently manufactured from readily available materials.

SUMMARY OF THE INVENTION

Briefly, the cap when attached to a baby's nursing bottle together provide a compartmental dispensing receptacle. The cap is of truncated conical shape, its larger end being dimensioned to frictionally engage the nipple cap of a nursing bottle and has a concave cavity formed therein which provides a protective shield for a nipple protruding from the nipple cap. The smaller, upper end of the cap has a top-loading compartment formed therein, separated by a partition from the concave cavity, for storing a premeasured amount of baby formula or milk in powdered form which when mixed with a predetermined amount of water contained in the bottle will produce a liquid formula mixture of desired concentration, ready to be dispensed via the nipple.

BRIEF DESCRIPTION OF THE DRAWINGS

Other objects, features and advantages of the invention will become apparent, and its construction and operation better understood, from the following detailed description read in conjunction with the accompanying drawings, in which.

DETAILED DESCRIPTION OF THE PREFERRED EMBODIMENT

Figure 1:
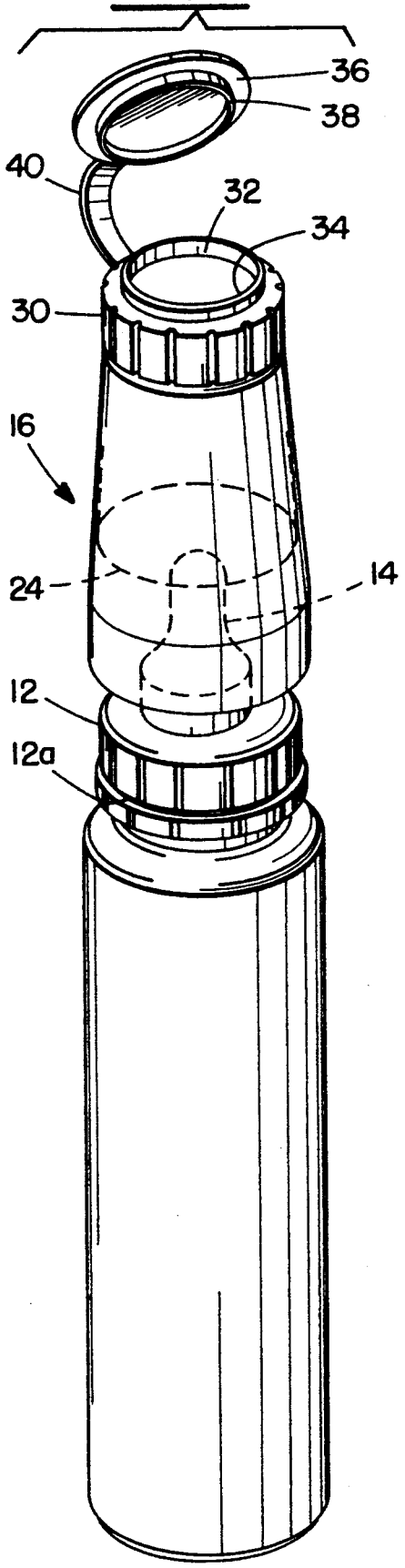
FIG. 1 is an exploded perspective view of a cap constructed in accordance with the invention attached to a conventional nursing bottle.

Referring to FIG. 1, the cap attachment of the invention is primarily intended for application to a conventional nursing bottle 10, which may be formed of clear glass or plastic and having a reduced neck portion provided with external threads (not shown) thereon adjacent the upper end on which a nipple cap 12 is threaded and within which a nipple 14 is mounted, either protruding as shown or inverted so as to project toward the interior of the bottle. In either position, the flange on the nipple, pressed by nipple cap 12 against the rim of the bottle, seals the bottle against leakage of its contents, be it water to be mixed with baby formula or already mixed formula.

Figure 2:
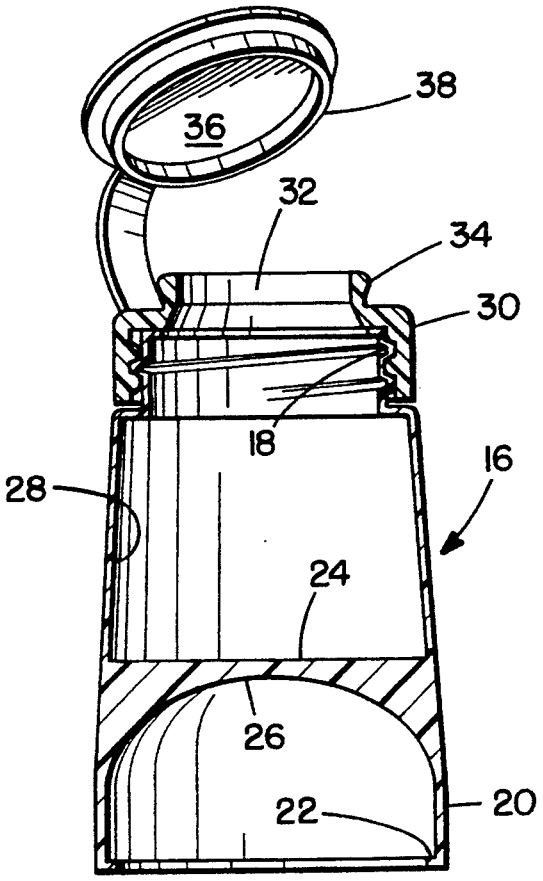
FIG. 2 is a sectional view of a cap constructed in accordance with the invention.

With continued reference to FIG. 1, and also to FIG. 2, cap attachment 16 of this invention may comprise a generally tubular body of truncated conical shape having a threaded reduced neck 18 at the upper end and terminating at the lower end in a skirt 20 of a size and configuration to frictionally engage the nipple cap 12 on bottle 10. The skirt 20 desirably may have a narrow interior lip 22 projecting radially inward from its lower edge for engaging, with a snap fit, the peripheral groove 12*a* provided near the lower edge of the nipple cap of a currently popular nursing bottle.

An integrally molded partition 24 separates the interior of tubular body 16 into two sections: a domed cavity 26 of sufficient height to receive and shield the nipple when the cap 16 is attached to the nipple cap 12, and an upper compartment 28 for storing baby formula or other ingredient in powdered form. The tubular body is molded from an elastic semi-rigid plastics material, preferably of the kind conventionally used for making nipple caps and nipple shields. The open top of the upper compartment 28 is closed by an internally threaded cap 30 having a central opening 32 surrounded by an upwardly extending rim 34 and a flat closure cap 36 having formed on one surface a circular wall 38 of a diameter approximating the outer diameter of rim 34 and otherwise dimensioned to engage the rim 34 with a snap fit. The closure cap 36 is attached to threaded cap 30 by a flexible strap 40 integrally molded with these two parts. The volume of compartment 28 is sufficient to contain an amount of powdered formula which upon being mixed with a full bottle of water would yield a liquid mixture having the highest concentration likely to be desired; by way of example, for use with an eight ounce bottle the storage compartment 28 preferably has capacity to hold four standard scoops of powdered formula.

Figure 4:
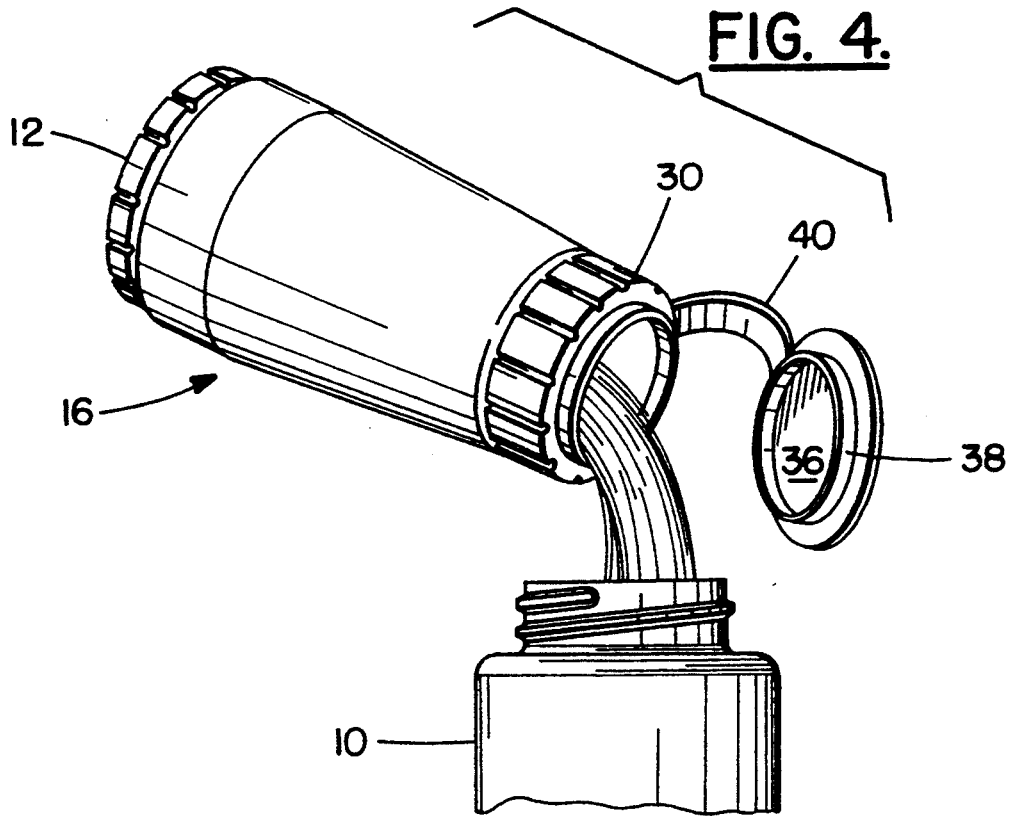
FIG. 4 is a perspective view illustrating the manner in which the cap shown in FIG. 2 is used to pour the contents stored in the cap into a bottle for mixing.

In use, preparatory to taking an infant on a trip of a duration that may require feeding, a premeasured amount of normally sterilized water is placed in the bottle 10 and the bottle sealed by the nipple 14 and nipple cap 12. The skirt. 20 of the truncated conical body 16 is then pressed into engagement with the nipple cap on the bottle, a desired pre-measured amount of powdered formula is scooped into the open end of the storage compartment, which may be done either with cap 30 off, or with cap 30 threadably engaging the threads 18 and its closure cap 36 open, following which the top of compartment 28 is closed. The combination of the inventive cap with a conventional nursing bottle provides a convenient travel container for a baby's "lunch on the road", eliminating the need to carry a bulky container of baby formula and a measuring scoop in the usually already overcrowded diaper bag. When it is desired to mix the formula stored in the compartment 28 with water stored in bottle 10 preparatory to dispensing the same, it is only necessary to unscrew the nipple cap 12, while keeping the present cap thereon, to open the mouth of bottle 10, open the closure cap 36, and, as depicted in FIG. 4, pour the powdered formula from compartment 28 into the open mouth of the bottle 10 and mix it with the water stored in the bottle. Then, the nipple cap 12 with the present cap still attached is replaced on the bottle, following which the then empty cap 16 is separated from the nipple cap to expose the dispensing nipple 14. After dispensing of a portion, or all, of the formula mixture, the tubular body 16 may be re-attached to the nipple cap to shield the nipple until again needed to dispense more formula and/or the assembly is taken apart for cleaning.

Figure 3:
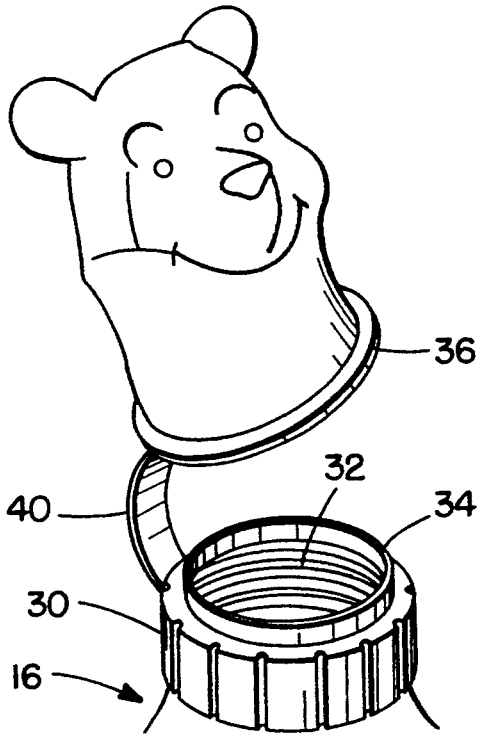
FIG. 3 is a perspective view showing an alternative construction of the closure for the cap.

As shown in FIG. 3, the closure cap 36 may be configured to resemble the head of an animal or other figure for the amusement of the infant, particularly during feeding time when the tubular body 16 is separated from the nursing bottle.

It will be seen that by the described invention there has been provided a relatively simple, yet highly effective attachment for a conventional container which serves to provide a compartmental dispensing receptacle which is especially useful in providing the ingredients for feeding an infant and also for keeping these ingredients separated until just prior to use, when the same may be mixed and dispensed merely by pouring the ingredient stored in a compartment formed in the cap attachment into another ingredient contained in the conventional container. Obviously, the inventive cap may be conveniently and economically manufactured from readily available materials and at a cost which will permit sale of the same in a highly competitive market.

It will now be apparent to one skilled in the art that various changes may be made in the invention, and that the invention may be used in ways other than that described, without departing from the spirit and scope thereof. For example, the closure for the top of compartment 28 may differ in details from the illustrated construction, and instead of using the compartment to store baby formula it may hold a premeasured amount of a powdered beverage mix, for example, to be mixed with water or other diluent stored in a container having a top closure adapted to be frictionally engaged by the cap. Therefore the invention is not limited by that which is shown in the drawings and described in the specification, but only as indicated in the appended claims.

I claim:

1. An attachment to a nursing bottle having a nipple removably attached to an open top end thereof with a nipple cap, said attachment comprising:

a tubular body terminating at an upper end in a closable opening and terminating at a lower end in a skirt portion dimensioned for frictional engagement with the nipple cap of said nursing bottle for removably connecting the attachment to the top end of the bottle, said tubular body having a transverse interior partition dividing the interior of said body into an upper storage compartment and a lower cavity for shielding the nipple projecting from said nipple cap, said tubular body when connected to said nipple cap providing a compartmental receptacle adapted to separately store a powdered ingredient in said storage compartment and a liquid ingredient in said nursing bottle to be mixed within and dispensed from said bottle, and closure means for the closable opening at the upper end of said tubular body adapted to be opened from a normally closed position for receiving through said opening a pre-measured amount of a powdered ingredient into said upper storage compartment or for pouring, when desired, a stored amount of said powdered ingredient from said upper storage compartment into said bottle to be mixed with a premeasured amount of a liquid ingredient stored in said bottle to form a liquid mixture to be dispensed through said nipple.

2. An attachment to a nursing bottle according to claim 1, wherein the closure means for the closable opening at the upper end of said tubular body includes a threaded cap threadably engaging threads formed on the exterior of the upper end of said tubular body for releasably securing the cap to the housing.

3. An attachment to a nursing bottle according to claim 2, wherein said closable opening is a central opening in said threaded cap, and wherein said closure means further comprises a snap cap attached to said threaded cap for selectively closing and opening said central opening.

4. An attachment to a nursing bottle according to claim 1, wherein the lower cavity of said tubular body is concave-shaped.

5. An attachment to a nursing bottle according to claim 1 wherein said tubular body has a truncated conical shape largest at said lower end.

6. An attachment to a nursing bottle having a nipple removably attached to an open top end thereof with a nipple cap for storing an edible powdered ingredient in close proximity to, but separately from, a liquid ingredient contained in the nursing bottle preparatory to mixing in the nursing bottle, when desired, the powdered ingredient and the liquid to produce a liquid mixture to be dispensed from the nipple projecting from the top end of the nursing bottle, said attachment comprising:

a tubular body terminating at an upper end in a closable opening and terminating at a lower end in a skirt portion dimensioned for frictional engagement with the nipple cap of the nursing bottle for removably connecting the attachment to the top end of the nursing bottle, a transverse partition disposed within said tubular body between the ends thereof, and closure means attached to the upper end of said tubular member for selectively closing and opening said closable opening, the cap, the transverse partition and the tubular body defining a storage compartment into which the powdered ingredient is poured through said closable opening and stored preparatory to subsequent mixing with the liquid ingredient contained in the nursing bottle, and the transverse partition and the skirt portion of said tubular body defining a domed chamber for enclosing the nipple projecting from a nursing bottle to which the attachment is connected, said closable opening when opened, and the attachment disconnected from the nursing bottle, permitting the powdered ingredient to be poured into the open top of the nursing bottle for mixing with the liquid ingredient contained in the bottle to form a liquid mixture to be dispensed through the nipple of the nursing bottle.

7. An attachment to a nursing bottle according to claim 6, wherein said closure means comprises a threaded cap dimensioned to threadably engage threads formed on the exterior of the upper end of said tubular body for releasably securing the threaded cap to the housing.

8. An attachment to a nursing bottle according to claim 7, wherein said closable opening is a central opening formed in said threaded cap, and wherein said closure means further comprises a snap cap connected to said threaded cap adapted for selective closing and opening of said central opening.

9. An attachment to a nursing bottle according to claim 6, wherein the skirt portion of said tubular body has a lip projecting radially inward from a lower edge thereof for engaging, with a snap fit, the nipple cover of a nursing bottle.

10. An attachment to a nursing bottle according to claim 6, wherein the skirt portion of said tubular body has a truncated conical shape largest at the lower end thereof, and wherein said skirt portion has a lip projecting radially inward from a lower edge thereof dimensioned to engage, with a snap fit, the nipple cover of a nursing bottle.

* * * * *